US005365909A

United States Patent [19]

Sawazaki et al.

[11] Patent Number: 5,365,909

[45] Date of Patent: Nov. 22, 1994

[54] IGNITOR FOR AN INTERNAL COMBUSTION ENGINE

[75] Inventors: Nobuyuki Sawazaki; Masaaki Taruya; Mitsuru Koiwa, all of Himeji, Japan

[73] Assignee: Mitsubishi Denki Kabushiki Kaisha, Tokyo, Japan

[21] Appl. No.: 76,200

[22] Filed: Jun. 14, 1993

[30] Foreign Application Priority Data

Jun. 15, 1992 [JP] Japan ..... 4-040766[U]
Sep. 17, 1992 [JP] Japan ..... 4-247981
Sep. 17, 1992 [JP] Japan ..... 4-247982

[51] Int. Cl.[5] ..... F02P 7/02; F02P 3/00

[52] U.S. Cl. ..... 123/617; 123/635; 123/647

[58] Field of Search ..... 123/635, 647, 612, 613, 123/617, 146.5 A

[56] References Cited

U.S. PATENT DOCUMENTS

| | | | |
|---|---|---|---|
| Re. 32,168 | 6/1986 | Yoshinari | 123/647 |
| 3,888,225 | 6/1975 | Boyer et al. | 123/617 |
| 4,224,917 | 9/1980 | Nakazawa et al. | 123/647 |
| 4,307,698 | 12/1981 | Yoshinari | 123/647 |
| 4,907,563 | 3/1990 | Kodama | 123/635 |
| 4,979,486 | 12/1990 | Shimada et al. | 123/635 |
| 5,058,559 | 10/1991 | Koiwa | 123/647 |
| 5,139,003 | 8/1992 | Ohhashi et al. | 123/635 |
| 5,159,532 | 10/1992 | Kilian et al. | 123/647 |

FOREIGN PATENT DOCUMENTS

| | | | |
|---|---|---|---|
| 8227 | 1/1979 | Japan | 123/647 |
| 59066 | 4/1982 | Japan | 123/647 |
| 29773 | 2/1984 | Japan | 123/647 |
| 171872 | 10/1986 | Japan . | |
| 27164 | 1/1990 | Japan . | |

*Primary Examiner*—E. Rollins Cross
*Assistant Examiner*—Thomas N. Moulis
*Attorney, Agent, or Firm*—Sughrue, Mion, Zinn, Macpeak & Seas

[57] ABSTRACT

An ignitor comprises an ignition coil unit mounted to a base and a control unit disposed on the ignition coil unit and electrically connected thereto for controlling a primary current to the ignition coil unit, which includes a base plate attached to the base and a crank angle sensor for detecting the turning angle of an engine crank shaft. The ignitor also comprises a rotary shaft rotatably supported by the base for rotation in synchronization with the rotation of an internal combustion engine which extends through the ignition coil unit and has a distributor rotor on an extended end thereof. The control unit further comprises a power switch package having a mold resin which hermetically molds therein a power transistor and an integrated controlling circuit into a sealed package. The power transistor interrupts an electric current flowing through a primary coil of the ignition coil and an integrated controlling circuit controls the power transistor.

10 Claims, 6 Drawing Sheets

IGNITOR FOR AN INTERNAL COMBUSTION ENGINE

BACKGROUND OF THE INVENTION

This invention relates to an engine ignition apparatus and, more particularly, to an ignitor for an internal combustion engine.

FIG. 9 is a sectional side view of a known ignitor for an internal combustion engine in which a base 1 is made of a metal such as aluminum and adapted to be securely mounted to an internal combustion engine (not shown). The base 1 has a bearing 1*c* for rotatably supporting a rotary shaft 3 which is adapted at one end 3*a* to be operably connected to and rotate in synchronization with an engine crankshaft (not shown). The base 1 has a first substantially planar top surface 1*a*, and vertically extending support posts 1*b* having a threaded hole 1*d* for receiving a screw 32 therein for the purpose which will become apparent later.

Disposed on the top surface 1*a* of the base 1 is an ignition coil unit 20. The ignition coil unit 20 has a central bore 20*a* through which the rotary shaft 3 extends. The ignition coil unit 20 also has primary and secondary coils (not shown) and an iron core (not shown).

The ignition coil unit 20 has a connector terminal 20*b* extending perpendicularly to the top surface 20*c* of the ignition coil unit 20 for electrical connection to the central electrode 10 disposed within a cap 2 which covers an opening of the base 1 and the ignition coil 20 together with other components. The cap 2 has a plurality of circumferential electrodes 12 to be connected to spark plugs (not shown) of an internal combustion engine (not shown).

A control unit 4 is disposed on the ignition coil unit 20. As illustrated in FIGS. 10 and 11, the control unit 4 is a substantially disc-shaped member and has a central bore 4*d* for allowing the rotary shaft 3 to extend therethrough and through holes 4*e* formed in the flange 4*f* for receiving the mounting screw 32 (See FIG. 9). FIG. 11 is a side view of the control unit 4 illustrated in FIG. 10. The control unit 4 comprises a base plate 4*a* having an aluminum heat sink 22 as illustrated in FIG. 13 attached at its bottom as shown in FIG. 9. The heat sink 22 has through holes 33 for receiving dowels 34 formed on the bottom of the base plate 4*a* as illustrated in FIG. 11. The control unit 4 also comprises a crank angle sensor 40 disposed on the base plate 4*a* for detecting a turning angle of the engine crank shaft (not shown) and a power switch for controlling a primary current to the ignition coil The crank angle sensor 40 comprises first and second Hall-effect IC sensors as magnetic sensors (not shown) and first and second magnets (not shown).

As illustrated in FIG. 12, the power switch 21 comprises a hybrid integrated circuit (HIC) 23 disposed on the heat sink 22 of the base plate 4*a* for controlling a primary current flowing through a primary coil of the ignition coil unit 20, and a power transistor 24 disposed on the heat sink 22 for interrupting or passing through a primary current for flowing through a primary coil of the ignition coil unit 20.

FIG. 14 is a sectional view of the control unit 4 taken along line XIV–XIV in FIG. 10. As illustrated in FIG. 14, an insulating plate 26 is disposed on the heat sink 22 of the base plate 4*a* for insulating the power transistor 24 from the heat sink 22. Disposed between the power transistor 24 and the insulating plate 26 is a heat sink 55.

The heat sink 55 has a coefficient of thermal expansion between those of the power transistor 24 and the insulating plate 26. The power transistor 24 and the HIC 23 (See FIG. 12) is covered with a resin 52 such as silicone which is comparatively soft for preventing a stress from outside and facilitating a radiation of heat. An insert conductor 51 is disposed within the base plate 4*a* and has one end within the power switch cavity electrically connected to a lead 50 extending from the power transistor 24. The other end of the insert conductor 51 is electrically connected to a connector for external connection.

As illustrated in FIG. 9, the first and the second disc plates 5 and 15, which are two concentric disc-shaped member made of magnetic material, are fixed to the top end of the rotary shaft 3 by means of a screw 7 and a blank 6 formed on the top end of the rotary shaft 3 so that the first and second disc plates 5 and 15 synchronously rotate therewith. Both of the first and second disc plates 5 and 15 have folding portions 5*a* and 15*a* at their edges respectively which are folded perpendicularly thereto. The folding portions 5*a* and 15*a* pass respectively through first and second grooves 8 and 18, illustrated in FIGS. 9 and 10, both formed between the Hall-effect IC sensors (not shown) and magnets (not shown) of the crank angle sensor 40.

Securely mounted on the blank 6 is a distributor rotor 9 which rotates synchronously with the rotary shaft 3 for distributing the high-tension secondary voltage supplied from the ignition coil unit 20. The rotor 9 has rotor electrode 11 disposed on the top thereof. The rotor 9 and other components are covered by a cap 2, as described above, which is attached to the control unit 4 by means of mounting brackets 2*b* having a through hole 2*c* for receiving the mounting screw 32 therein. As illustrated in FIG. 9, the center electrode 10 disposed within the cap 2 is electrically connected to the rotor electrode 11 of the rotor 9. A plurality of circumferential electrodes 12 are disposed within the cap 2 for each spark plug of cylinder of the internal combustion engine (not shown) for distributing a secondary voltage from the ignition coil unit 20 through the rotor electrode 11 in turn to ignite the spark plugs.

In the known ignitor as described above, when the rotary shaft 3 rotates synchronously with the engine crank shaft (not shown) of the internal combustion engine, the first and second disc plates 5 and 15 disposed thereon ere also rotated synchronously. As the folding portion 5*a* and 15*a* pass through the first and second grooves 8 and 18, a magnetic flux from the first and second magnets (not shown) to the first and the second Hall-effect IC sensors (not shown) is interrupted by the folding portion 5*a* and 15*a*. The first and the second Hall-effect IC sensors detect this as a change of the magnetic flux in relation to the rotation of the rotary shaft 3. The first Hall-effect IC sensor converts the change of the magnetic flux to electronic signals to be supplied to a control computer (not shown). The electronic signals are processed by the control computer and transmitted to the power switch 21 which comprises the HIC 23 and the power transistor 24. As the result, the primary current of the ignition coil unit 20 is controlled, and, a secondary voltage are created in the ignition coil unit 20 on an ignition timing. The secondary voltage is distributed to the circumferential electrodes 12 in turn through the center electrode 10 and the rotor electrode 11 accompanying with the rotation of the rotor 9. The spark plugs of the cylinder is ignited in turn and the internal combustion engine operates continuously.

On the other hand, the second Hall-effect IC sensor converts the above change of the magnetic flux to electronic signals so that the electronic signals are supplied for identifying the engine cylinder.

During assembly of the known ignitor as above described, when the power switch 21 is assembled on the heat sink 22, firstly the HIC 23 and the power transistor 24 are fixed on the heat sink 22 as illustrated in FIG. 13 and the leads 50 and 53, each connected to the HIC 23 and the power transistor 24 respectively by for example solder, are electrically connected to the leads such as 51 which extend to the crank angle sensor unit 40 or the like. Further, the heat sink 55 which has a coefficient of thermal expansion between those of the power transistor 24 and the insulating plate 26, must be disposed between the power transistor 24 and the insulating plate 26 for absorbing the difference in the coefficients of thermal expansion of the power transistor 24 and the insulating plate 26. The heat sink 55 and the insulating plate 26 ere made of a material having a high thermal conductivity. Next, the HIC 23 and the power transistor 24 are covered with the soft resin 52 such as silicone for a protection from outside stresses. However, the resin 52 is not enough for protecting. So, the power switch 21 must be provided with a hermetic cover 21*a*.

During assembly of the above known ignitor, before the power transistor 24 is fixed with a solder on the aluminum heat sink 22, a surface of the a surface of the heat sink 22 should be plated for soldering. As the heat sink 22 is large as illustrated in FIG. 13, it is hard to heat the heat sink 22 to a temperature high enough for soldering.

As illustrated in FIG. 13, during welding or soldering for an electrical conductor connection, the power transistor 24 and the HIC 23 are exposed. Welding dust therefore which is generated during welding can adhere to surfaces of the power transistor 24 and the HIC 23. Ambient moisture can also enter into these components. If the dust or moisture is attached to these components, they will happen to be damaged. So, several minute assembly processes with substantial attention to dust and moisture contamination are necessary. Many electrical connecting processes between the components on the heat sink 22 are needed during assembly. Even the soft resin 52, may prove inadequate for protecting the connections. Therefore the reliability is not good and the assembly processes are not efficient.

SUMMARY OF THE INVENTION

Accordingly, one object of the present invention is to provide an ignitor for an internal combustion engine which can be easily assembled and is simple in structure.

Another object of the present invention is to provide an ignitor which is reliable.

A further object of the present invention is to provide an ignitor in which a radiation of heat can be very efficient.

A still further object of the present invention to provide a power switch package of an ignitor which are watertight.

With the above objects in view, the igniter of the present invention comprises an ignition coil unit mounted to a base and a control unit disposed on the ignition coil unit end electrically connected thereto for controlling a primary current to the ignition coil unit, which includes a base plate attached to the base and a crank angle sensor for detecting the turning angle of an engine crank shaft. The ignitor of the present invention also comprises a rotary shalt rotatably supported by the base for rotation in synchronization with the rotation of an internal combustion engine which extends through the ignition coil unit and has a distributor rotor on an extended end thereof. The control unit further comprises a power switch package having a mold resin which hermetically molds therein a power transistor and an integrated controlling circuit into a sealed package. The power transistor interrupts an electric current flowing through a primary coil of the ignition coil and an integrated controlling circuit controls the power transistor.

BRIEF DESCRIPTION OF THE DRAWINGS

The present invention will become more readily apparent from the following detailed description of the preferred embodiments of the present invention taken in conjunction with the accompanying drawings, in which.

DESCRIPTION OF THE PREFERRED EMBODIMENTS

Figure 9:
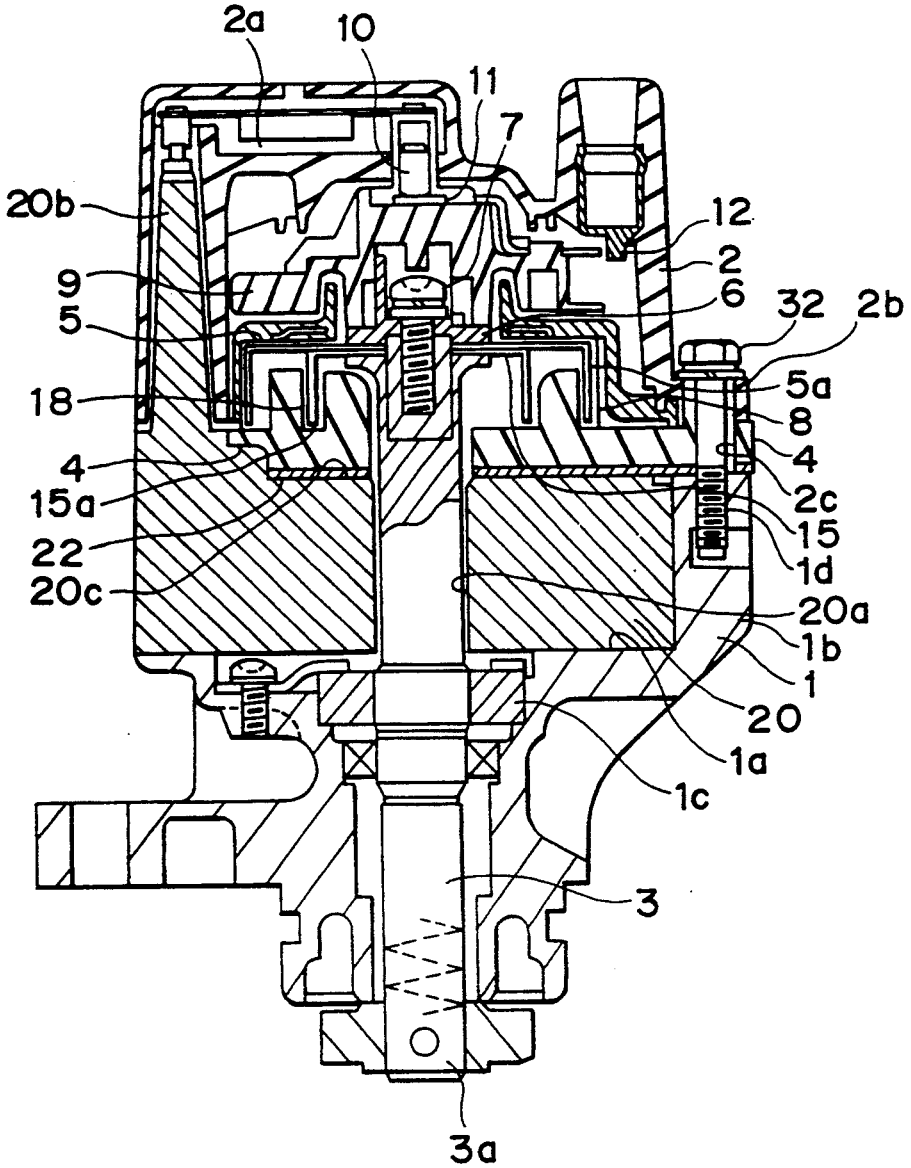
FIG. 9 (PRIOR ART)
FIG. 9 is a sectional view of a known ignitor.
Figure 10:
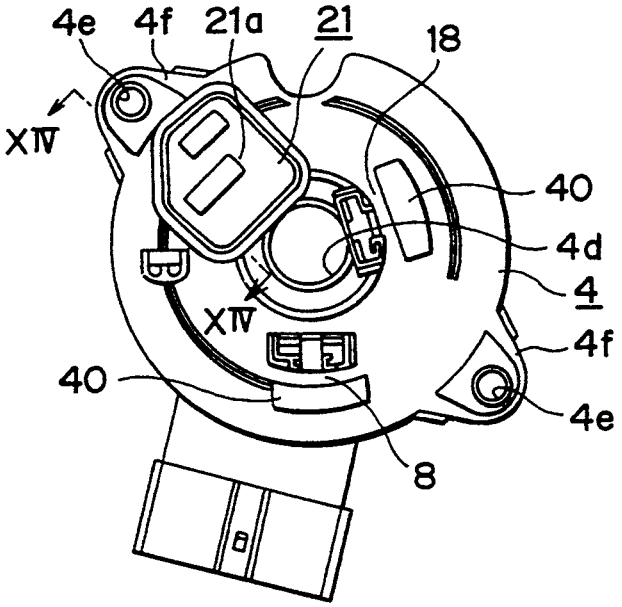
FIG. 10 (PRIOR ART)
FIG. 10 is a plan view of a control unit of the known ignitor illustrated in FIG. 9.
Figure 11:
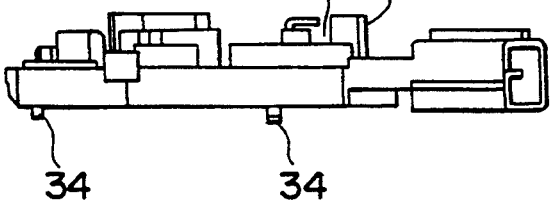
FIG. 11 (PRIOR ART)
FIG. 11 is a side view of the control unit illustrated in FIG. 10.

FIGS. 1 to 4 illustrate one embodiment of a control unit of the ignitor of the present invention. The ignitor of the present invention has basically the same structure as that of the known ignitor illustrated in FIG. 9, but is different in the control unit 104 (See the known control unit 4 in FIG. 9). The other structures are completely the same as that of FIG. 9. The figure showing the whole structure of the ignitor of the present invention like FIG. 9 is therefore omitted substituting FIG. 9 for it. Roughly describing here, as seen from FIG. 9, the ignitor of the present invention also comprises a base 1 made of a metal Such as aluminum and adapted to be securely mounted to an internal combustion engine (not shown). The base 1 is a substantially disc-shaped member having a bearing 1*c*. A rotary shaft 3 is rotatably supported by the base 1 by means of the bearing 1*c* thereof for rotation in synchronization with the rotation of an internal combustion engine. The base 1 has a first substantially planar top surface 1*a*, and an ignition coil unit 20 is mounted on the top surface 1*a*. The ignition coil unit 20 is a relatively thick, substantially disc-shaped resin-molded member. The rotary shaft 3 extends through a central bore 20*a* of the ignition coil unit 20.

An integrally resin-molded control unit 104 is disposed on the ignition coil unit 20 similarly to the control unit 4 of the known ignitor illustrated in FIG. 9 for controlling a primary current to the ignition coil unit 20. The control unit 104 comprises first and second grooves 8 and 18 both formed between Hall-effect IC sensor (not shown) and magnets (not shown) both which the control trait 104 also comprises. First and second disc plate 5 and 15 which are two concentric disc-shaped member made of magnetic material are mounted to the top end of the rotary shaft 3 by means of a blank 6 formed on the extended top end of the rotary shaft 3. Both of the first and second disc plate 5 and 15 have folding portions 5*a* and 15*a* at their edges respectively, each are folded perpendicularly thereto. The folding portions 5*a* and 15*a* respectively pus through the first and second grooves 8 and 18 of the control unit 104. The control unit 104 also comprises a crank angle sensor unit 140 which operates in cooperation with the folding portions 5*a* and 15*a* of the first and second disc plate 5 and 15 mounted to the top end of the rotary shaft 3. The crank angle sensor unit 140 generates a signal indicative of rotational position and/or speed of the engine crank shaft (not shown) as is well-known in the art. Securely mounted to the top of the blank 6 is a distributor rotor 9 for distributing the high-tension secondary voltage supplied from the ignition coil unit 20. The rotor 9 bas a rotor electrode 11 disposed on the top thereof. The rotor 9 and other components are covered by a cap 2 attached to the control unit 104 by means of mounting brackets 2*b* having a through hole 2*c* for receiving the mounting screw 32 therein. The cap 2 comprises an electrical conductor 2*a*, a center electrode 10 and a plurality of circumferential electrodes 12. As is well known in the art, the high-tension voltage from the ignition coil unit 20 is sequentially supplied to the circumferential electrodes 12 through a connector terminal 20*b* of the ignition coil unit 20, the electrical conductor 2*a*, the center electrode 10 and the rotor 9 as it is rotated by the rotary shaft 3.

Figure 1:
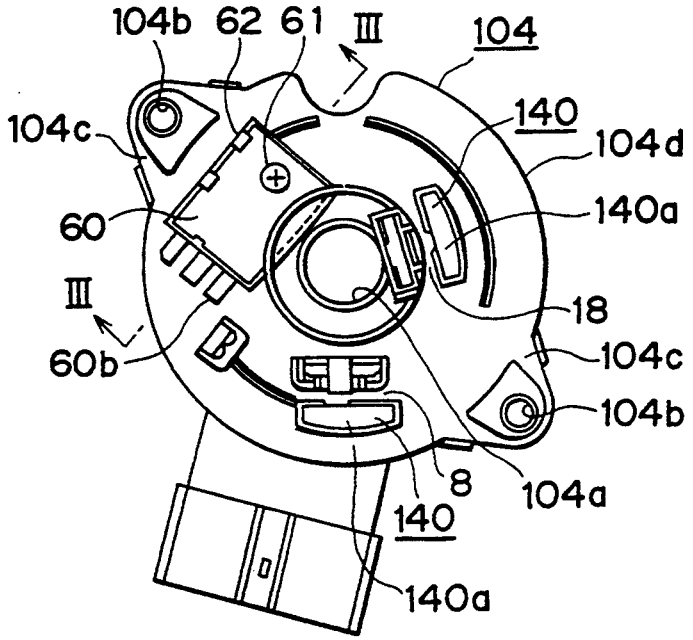
FIG. 1 is a plan view of a embodiment of a control unit of an ignitor for an internal combustion engine of the present invention.

FIG. 1 is a plan view of the control unit 104 of the present invention. As best seen from FIG. 1, the control unit 104 is a substantially disc-shaped member and has a base plate 104*d*. The base plate 104*d* has a central bore 104*a* for allowing the rotary shaft 3 to extend therethrough and through holes 104*b* formed in the frange 104*c* for receiving the mounting screw 32 (See FIG. 9). The base plate 104*d* is an electrically insulating plate made of resin and having an aluminum heat sink 122 attached to the bottom surface of the insulating plate. The control unit 104 comprises crank angle sensors 140 and a molded power switch package 60 which are disposed on the base plate 104*d*. The power switch package 60 is integrally molded by a mold resin 60*a* and will be described later. The crank angle sensor 140 is electrically connected to the ignition coil unit 20 for controlling a primary current to the ignition coil unit 20. The crank angle sensor 140 comprises a crank angle sensor 140*a* such as a Hall-effect sensor for detecting the turning angle of a engine crank shaft (not shown).

Figure 3:
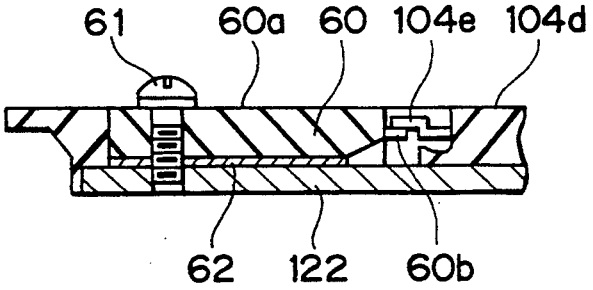
FIG. 3 is a schematic sectional view of a embodiment of a power switch package taken along line III—III in FIG. 1.
Figure 12:
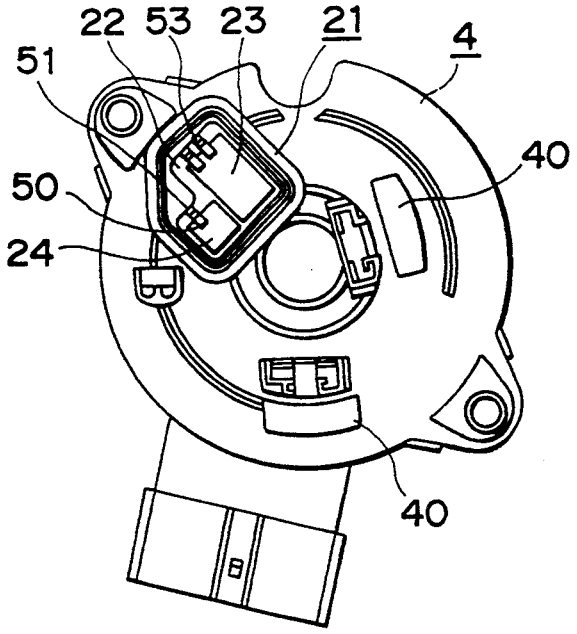
FIG. 12 (PRIOR ART)
FIG. 12 is a plan view of the control unit illustrated in FIG. 10 but with a cover of the power switch removed for clarity.
Figure 13:
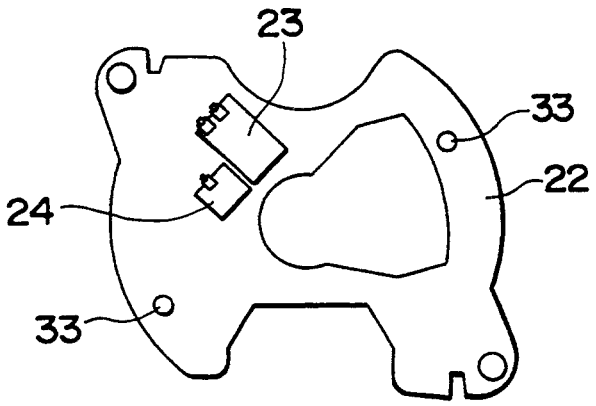
FIG. 13 (PRIOR ART)
FIG. 13 is a plan view of a power transistor and a hybrid integrated circuit (HIC) disposed on a heat sink of the control unit illustrated in FIG. 12.
Figure 14:
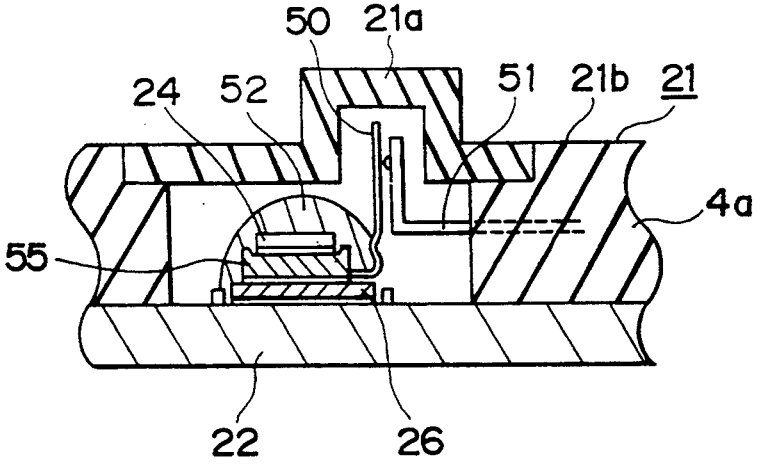
FIG. 14 (PRIOR ART)
FIG. 14 is a fragmental sectional view taken along line XIV—XIV in FIG. 10.

FIG. 3 is a schematic sectional view taken along line III—III in FIG. 1. As illustrated in FIG. 3, a molded power switch package 60 is fixed to the heat sink 122 by means by screw 61. The molded power switch package 60 comprises a power transistor (not shown) similar to the transistor 24 shown in FIGS. 12 and 13 for interrupting an electric current flowing through a primary coil of the ignition coil and an integrated controlling circuit such as HIC similar to the HIC 23 shown in FIGS. 12 and 13 for controlling the power transistor. The power switch package 60 also comprises a mold resin 60*a* for hermetically sealing therein the power transistor and the integrated controlling circuit into a sealed package 60. The mold resin 60*a* has a hardness enough to protect inside from outside. A plurality of leads 60*b* extends from the mold resin 60*a* for connecting to inserts 104*e* disposed within the insulating base plate 104*d*. The leads 60*b* are welded to the inserts 104*e* to provide electrical connections therebetween.

In the ignitor of the present invention as described above, as illustrated in FIGS. 3 and 4, an insulating plate 62 buying a high thermal conductivity is attached to the heat sink 122. And the molded power switch package 60 is disposed on the insulating plate 62 and fixed by the screw 61.

Figure 2:
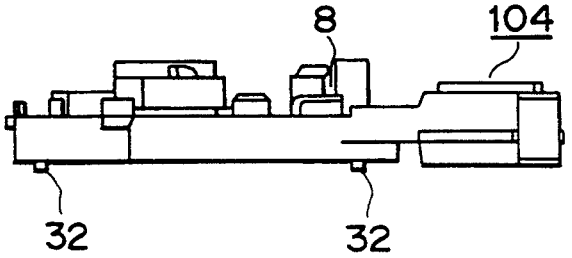
FIG. 2 is a side view of the control unit illustrated in FIG. 1.
Figure 4:
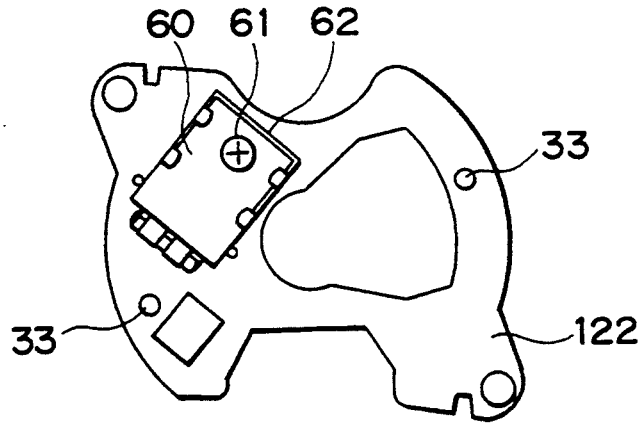
FIG. 4 is a plan view of the power switch package disposed on a heat sink of the control unit illustrated in FIG. 1.

As illustrated in FIG. 4, the heat sink 122 has through holes 33 for receiving dowels 32 formed on the bottom of the base plate 104*d* of the control unit 104 as illustrated an FIG. 2. The base plate 104*d* is bonded by for example a bonding agent to the heat sank 122 and the dowels 32 of the base plate 104*d* is inserted into the through holes 33 of the heat sink 122. After welded, the base plate 104*d*, the heat sink 122 and the power switch package 60 disposed on the heat sink 122 are integrated to compose an integral control unit 104.

In this embodiment of the present invention described above, as the power switch package 60 is composed of the power transistor and the integrated controlling circuit which are hermetically molded by the mold resin into a sealed package, the power switch package 60 is protected from dusts and ambient moisture, and further, from outside stresses. As the power switch package 60 is easy to handle, and electrical connection between the power switch package 60 and the crank angle sensor unit 140 are very simplified. The assembly processes therefore become very efficient. Further, as leads which are connected to the power transistor and the integrated controlling circuit are disposed within the mold resin 60*a* having enough hardness, connecting portions cannot be damaged and the ignitor becomes reliable.

Figure 5:
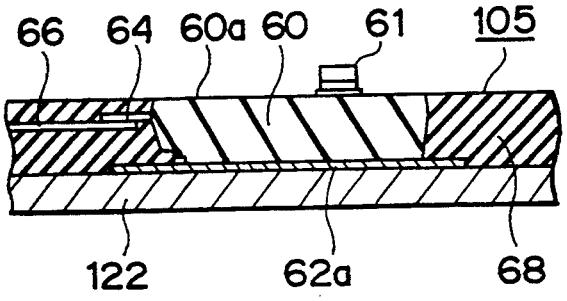
FIG. 5 is a sectional view of another embodiment of the power switch package of the present invention.

FIG. 5 illustrates another embodiment of the control unit of the ignitor of the present invention in which a molded power switch package and a crank angle sensor unit are molded hermetically by a mold resin integrally into a molded control unit 105 and an elastic insulating plate 62*a* is disposed between the power switch package 60 and the heat sink 122. Similarly to the above embodiment, the power switch package 60 is composed of the power transistor and the integrated controlling circuit which are hermetically molded by the mold resin 60*a* into a sealed package as illustrated in FIG. 5 and is disposed on a heat sink 122 by the medium of an insulating plate 62*a* and fixed by a bonding paste (not shown)

and fastening means such as a screw 61. In this embodiment, the insulating plate 62*a* is an elastic electrically insulating, heat conductive member for insulating between the heat sink 122 and the power switch package 60 and for absorbing surface roughnesses of the heat sink 122 and the power switch package 60 so that they become in an intimate contact with the insulating plate 62*a* and a heat conduction from the power switch package 60 to the heat sink 122 becomes accelerated. The power switch package and the crank angle sensor 140 are molded integrally by a mold resin 68 which defines the base plate.

In this embodiment, during assembly, after a lead 64 of the power switch package 60 is welded to an insert which has one end connected to a connector, to provide electrical connection therebetween, the power switch package 60 is insert-molded completely by the mold resin 68 of the base plate as illustrated in FIG. 5. The mold resin 68, which molds the power switch package 60 hermetically, composes a frame of the crank angle sensor unit 140. The power switch package 60 and the crank angle sensor unit 140 are therefore unified into a molded control unit 105.

Next, the power switch package 60 is mounted to the heat sink 122 by the insulating plate 62*a* and fixed by a screw 61. The power switch package 60, the crank angle sensor unit 140, the heat sink 122 and the mold resin 68 are unified integrally to compose an integral control unit 105.

Figure 6:
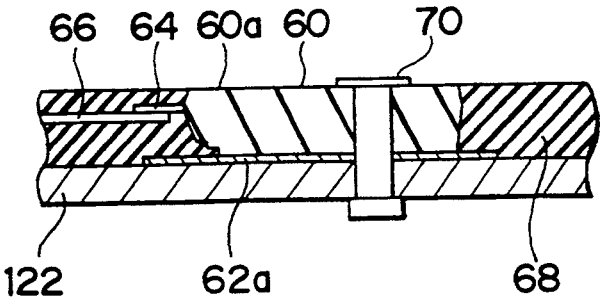
FIG. 6 is a sectional view of still another embodiment of the power switch package of the present invention.

FIG. 6 illustrates another embodiment of the control unit of the present invention, which has a basically the same structure as that illustrated in FIG. 5 but is different in fastening means. The power switch package 60 may be fixed to the heat sink 122 by a rivet 70 passing through the power switch package 60, the insulating plate 62*a* and the heat sink 122 as illustrated in FIG. 6.

In these embodiments illustrated in FIGS. 5 and 6, the power switch package 60 is composed of the power transistor and the integrated controlling circuit which are hermetically molded by the mold resin 60*a* into a sealed package, and further, the power switch package 60 and the crank angle sensor unit 140 ere molded by the mold resin 68 integrally into the molded control unit. The power switch package 60 is protected from dusts, moisture and outside stresses and it is therefore easy to handle and can be easily assembled.

As the insulating plate 62*a* is made of an electrically insulating, heat conductive plate having elasticity, surface roughnesses of the heat sink 122, the power switch package 60 and the mold resin 68 can be absorbed by the compression of the insulating plate 62*a* when the power switch package 60 is urged against the heat sink 62*a* under pressure. The power switch package 60 and the mold resin 68 are in an intimate contact with the heat sink 122 through the insulating plate 62*a*, so that the heat conduction from the power swatch package 60 to the heat sink 122 is very efficient.

Figure 7:
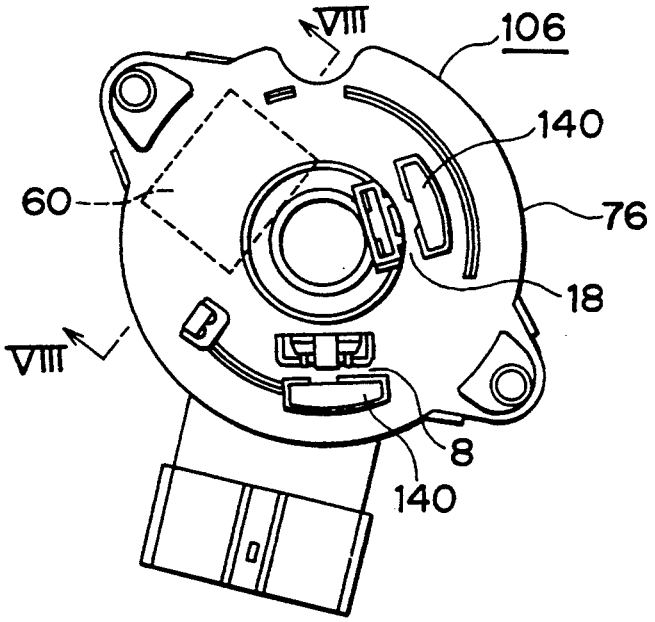
FIG. 7 is a plan view of another embodiment of the control unit of the present invention.
Figure 8:
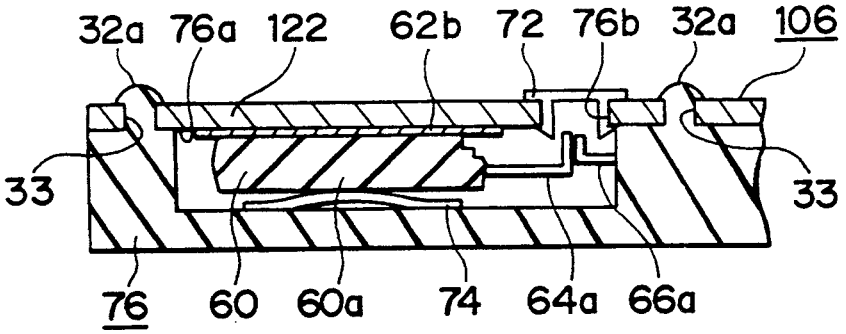
FIG. 8 is a fragmental sectional view of the control unit taken along line VII—VII in FIG. 7.

FIGS. 7 and 8 illustrate still another embodiment of the control unit of the ignitor of the present invention which comprises spring means such as a leaf spring 74 for pressing a molded power switch package 60 against a heat sink 122. The power switch package 60 is hermetically molded by a mold resin 50*a*, in which a power transistor (not shown) and an integrated controlling circuit (not shown) are disposed, similarly to the above embodiments. A substantially L-shaped lead 64*a* is electrically connected to the power switch package 60 and extends outwardly therefrom.

The control unit 106 comprises a base plate 76 made for example of a resin and has a substantially disc-shape, as seen from FIG. 7. The control unit 106 also comprises a crank angle sensor unit 140 disposed on the base plate 76. As illustrated in FIG. 8, the leaf spring 74 is disposed within the cavity of the base plate 76. The leaf spring 74 has a substantially bow-shape and is disposed between the molded power switch package 60 and the base plate 76.

The cavity of the base plate 76 has an opening 76*a* which is covered with a heat sink 122 excepting a portion 76*b* provided for lead connecting. The heat sink 122 has through holes 33 (See FIG. 4) for receiving dowels 32*a* extending outwardly from a surface of the base plate 76 as illustrated in FIG. 8. The heat sink 122 is disposed on the base plate 76 so that the dowels 32 of the base plate 76 are inserted into and pierce the through holes 33 of the heat sink 122. The heat sink 122 is also bonded to the base plate 76 by for example a bonding agent to establish a hermetic seal. Disposed to the heat sink 122 in contact with the power switch package 60 is an electrically insulating heat conducting plate 62*b* for electrically insulating between the heat sink 122 and the power switch package 60 and promoting a heat conduction from the power switch package 60 to the heat sink 122. The power switch package 60 is pressed against the heat sink 122 through the insulating plate 62*a* for providing a hermetic contact therebetween to make a heat conduction from the power switch package 60 to the heat sink 122 very efficient. The L-shaped leads 64*a* of the power switch package 60 are welded to L-shaped conductors 66*a* disposed within the base plate 76 for providing an electrical connection therebetween which is exposed through the opened portion 76*b*. The opened portion 76*b* is covered hermetically with a cover 72 after the connection of the conductor 64*a* and 66*a*. The power switch package 60, the heat sink 122 and the base plate 76 having the crank angle sensor unit 140 thereon are integrated to compose the integral control unit 106.

In this embodiment, the power switch package 60 is molded integrally into a sealed package by the mold resin 60*a*, the number of the elements mounted on the control trait 106 is decreased and the control unit 106 can be easily assembled and becomes watertight. Electrical Connections between electrical components disposed within the power switch package 60 are disposed inside of the mold resin 60*a*, so that the connecting portions cannot be damaged and the ignitor of the present invention becomes reliable.

As the control unit 106 comprises the spring means such as the leaf spring 74 for pressing the power switch package 60 against the heat sink 122 through the insulating radiator plate 62*b*, the heat conduction from the power switch package 60 to the heat sink 122 is highly promoted.

While the embodiment described above comprise the Hall-effect sensor as the crank angle sensor, an optical sensor including a photodiode may be used in place it. For the HIC as the integrated controlling circuit disposed within the power switch package 60, a power transistor chip, a monolithic IC and that having a multichip module structure in which a resistor chip mounted on a lead frame is molded by a mold resin are appropriate.

What is claimed is:

1. An ignitor for an internal combustion engine, comprising:

a base;

an ignition coil unit mounted to said base;

a control unit mounted to said base and electrically connected to said ignition coil unit for controlling a primary current to said ignition coil unit; and a rotary shaft rotatably supported by said base for rotation in synchronization with the rotation of an internal combustion engine, said rotary shaft having a distributor rotor on an extended end thereof;

said control unit comprising: a base plate attached to said base; a crank angle sensor,, attached to said base plate, for detecting the turning angle of an engine crank shaft; and a molded power switch package containing a power transistor for interrupting an electric current flowing through a primary coil of said ignition coil, an integrated controlling circuit for controlling said power transistor, and a hard mold resin hermetically sealing said power transistor and said integrated controlling circuit into said molded power switch package.

2. An ignitor as claimed in claim 1, wherein said crank angle sensor and said power switch package are disposed within a package unit integrally to compose an integral control unit.

3. An ignitor as claimed in claim 1, wherein said base plate of said control unit comprises a heat sink and said power swatch package is fixed on said heat sink by fastening means.

4. An ignitor as claimed in claim 3, wherein said fastening means comprises a rivet passing through said power switch package and said heat sink.

5. An ignitor as claimed in claim 3, wherein said heat sink comprises an elastic electrically insulating heat conducting means disposed between said heat sink and said power switch package for promoting a heat conduction to said heat sink.

6. An ignitor as claimed in claim 2, wherein said base plate of said control unit comprises a heat sink contacting said power switch package and said power switch package is pressed against said heat sink by spring means disposed in said base plate.

7. An ignitor as claimed in claim 6, wherein said spring means comprises a leaf spring having an edge attached to said base plate.

8. An ignitor as claimed in claim 6, wherein said heat sink comprises an elastic, electrically insulating, heat conductive sheet disposed between said heat sink and said power switch package for promoting a heat conduction to said heat sink.

9. An ignitor as claimed in claim 1, wherein a conductor insert including one end for being connected to a connector is disposed within said base plate and said power switch package comprises a lead projecting from said mold resin package, said lead of said power switch package and said conductor insert are electrically connected within a cavity of said base plate.

10. An ignitor as claimed in claim 1, wherein said base plate is a heat sink, and wherein said power switch package is thermally coupled to said heat sink.

* * * * *